US006231401B1

(12) United States Patent
Chooi Au Yong et al.

(10) Patent No.: US 6,231,401 B1
(45) **Date of Patent: *May 15, 2001**

(54) ELECTRICAL CONNECTOR WITH PIN RETENTION

(75) Inventors: Seong Chooi Au Yong; Nai Hock Lwee, both of Singapore (SG)

(73) Assignee: Thomas & Betts International, Inc., Sparks, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/993,498

(22) Filed: Dec. 18, 1997

Related U.S. Application Data

(60) Provisional application No. 60/034,287, filed on Dec. 18, 1996.

(51) Int. Cl.[7] ..... H01R 13/415

(52) U.S. Cl. ..... 439/741; 439/747; 439/733.1

(58) Field of Search ..... 439/733.1, 739, 439/749, 741.2, 743, 744, 746, 747, 748, 751, 752, 943, 74, 870, 84

(56) References Cited

U.S. PATENT DOCUMENTS

| | | | | |
|---|---|---|---|---|
| 3,500,299 | | 3/1970 | De Vito . | |
| 4,379,611 | * | 4/1983 | Foege et al. | 439/742 |
| 5,017,159 | * | 5/1991 | Legrady | 439/741 |
| 5,147,228 | | 9/1992 | Miller et al. . | |
| 5,639,269 | * | 6/1997 | Vanbesien et al. | 439/741 |
| 5,766,025 | * | 6/1998 | Davis | 439/660 |

FOREIGN PATENT DOCUMENTS 971 302 1/1959 (DE) .

* cited by examiner

*Primary Examiner*—Lincoln Donovan
(74) *Attorney, Agent, or Firm*—Hoffmann & Baron, LLP

(57) ABSTRACT

An electrical connector includes an insulative housing having at least one elongate aperture and an electrical contact insertable therethrough. The contact includes a first end extending externally through a first end of said aperture and an opposed second end extending externally through a second end of said aperture. The contact further includes a deformable flange adjacent said first end of the contact for expanded deformation so as to prevent removal of said contact from said housing aperture in a direction opposite said direction of insertion.

7 Claims, 5 Drawing Sheets

ELECTRICAL CONNECTOR WITH PIN RETENTION

This application claims the benefit of U.S. Provisional application No. 60/034,287, filed Dec. 18, 1996.

FIELD OF THE INVENTION

The present invention relates generally to electrical connectors. More specifically, the present invention relates to a pin retention means employed in an electrical connector.

BACKGROUND OF THE INVENTION

The use of multi-contact connectors is a well-known method for providing an organized and orderly connection of multiple leads such as in electronic devices. Multi-contact connectors terminate conductors and cables between electronic circuits within a system, between systems, and between systems and external power sources and signal lines. Multi-contact connectors interconnect circuits on circuit boards with backplanes or backpanels or wiring within an enclosure. They may also interconnect chassis and circuit boards in different enclosures.

Such connectors come in a variety of shapes including trapezoidal, rectangular, and circular. These connectors typically include an electrically insulative connector housing containing multiple apertures through which conductive connector contacts are inserted. These connector contacts, a plurality of which are included in such connector assemblies, are connected to separate incoming wires and a dielectric insert assembly for fixedly or removably mounting the electrical contacts in the connector shell.

For example, right angle, D-faced electrical connectors are used in the electronics industry as input/output devices to interconnect a computer to external peripheral equipment. The contacts of the electrical connector are typically soldered to conductive traces on a printed circuit board at a backwall or panel of the computer. The front face on the connector is mated with a complementary electrical connector which is attached to the peripheral equipment.

These types of electrical contacts are supported in apertures in the insulative housing of the connector with back ends of the contacts bent at right angles. The contacts terminate in solder posts which extend downward from the connector housing for insertion into through-plated holes in a printed circuit board for subsequent soldering thereto.

Typically the contacts are held in place by an interference fit between the contact and the wall forming the aperture in the connector housing by either oversizing the contact to the aperture or by providing barbs on the contact which engage the internal wall defining the aperture.

However, by employing an interference fit between the contacts and the connector housing, several problems are commonly experienced. One such problem is that the insertion fit can cause warpage of the connector housing. Also, the insertion forces required to insert contact pins through the connector housing can sometimes bend, misalign, or skew either the pins or the solder tails. As mentioned above, because of the importance of properly aligning the solder tails to the appropriate terminal in the printed circuit board, such misalignment can render a connector unusable.

Furthermore, interference fit connectors require a precise fit between the hole and contact in order to eliminate some of the above-mentioned problems. This necessitated the use of tight tolerances which increased production costs.

U.S. Pat. No. 5,017,159 discloses an electric terminal for mounting electrical components on printed circuit boards. A mounting leg is employed to secure the connector to the printed circuit board. This mounting leg includes at least one elongate indentation in the mounting end parallel to the longitudinal axis which facilitates the splitting of the mounting leg along the indentation into two half leg portions and splaying the two half leg portions into abutment against the opposed side of the printed circuit board to secure the position of the terminal on the printed circuit board. However, it has been found that in some cases splaying does not follow the coin along the center of the leg, but favors one side and results in an asymmetrical one sided splay. Such off center splaying has a tendency to further pull the terminal pin off the original center line perpendicular to the printed circuit board surface.

SUMMARY OF THE INVENTION

It is an object of the present invention to provide an electrical connector which insulatively supports contacts within a connector housing.

It is also an object of the present invention to provide an electrical connector where the contacts can be easily inserted into the connector housing without change to the contacts or the housing.

A further object of the invention is to provide a connector where the contacts are easily inserted into the connector housing which thereby eliminates misalignment of the pins or solder tails by the high insertion forces of the prior art.

In order to achieve these and other objectives, the present invention comprises an electrical connector comprising an insulative housing having an elongate aperture therethrough. An elongate electrical contact is insertable within said housing aperture in a direction of insertion, said contact having a first end extending externally through a first end of said aperture, and an opposed second end extending externally through a second end of said aperture. The contact further includes a deformable flange adjacent the first end of the contact for expanded deformation so as to prevent removal of said contact from said housing aperture in a direction opposite said direction of insertion.

The present invention also comprises an electrical connector comprising an insulative housing having a connection face and an opposed termination face, and a plurality of elongate apertures extending between the connection face and the termination face. Also included is a plurality of mated elongate electrical contacts insertable within said housing from said termination face to said connection face. The contacts have first ends extending externally through first ends of said apertures, and opposed second ends extending externally through opposed second ends of said apertures. The contacts further include a deformable flange adjacent said first end of the contacts for expanded deformation so as to prevent removal of said contacts through said termination face.

DETAILED DESCRIPTION OF THE INVENTION

The present invention provides an electrical connector which supports a plurality of contacts in a housing unit within a mated aperture. The electrical contacts are retained in a receiving aperture by the expansion of a deformable flange portion of the contact once the contact is inserted in the aperture.

Figure 1:
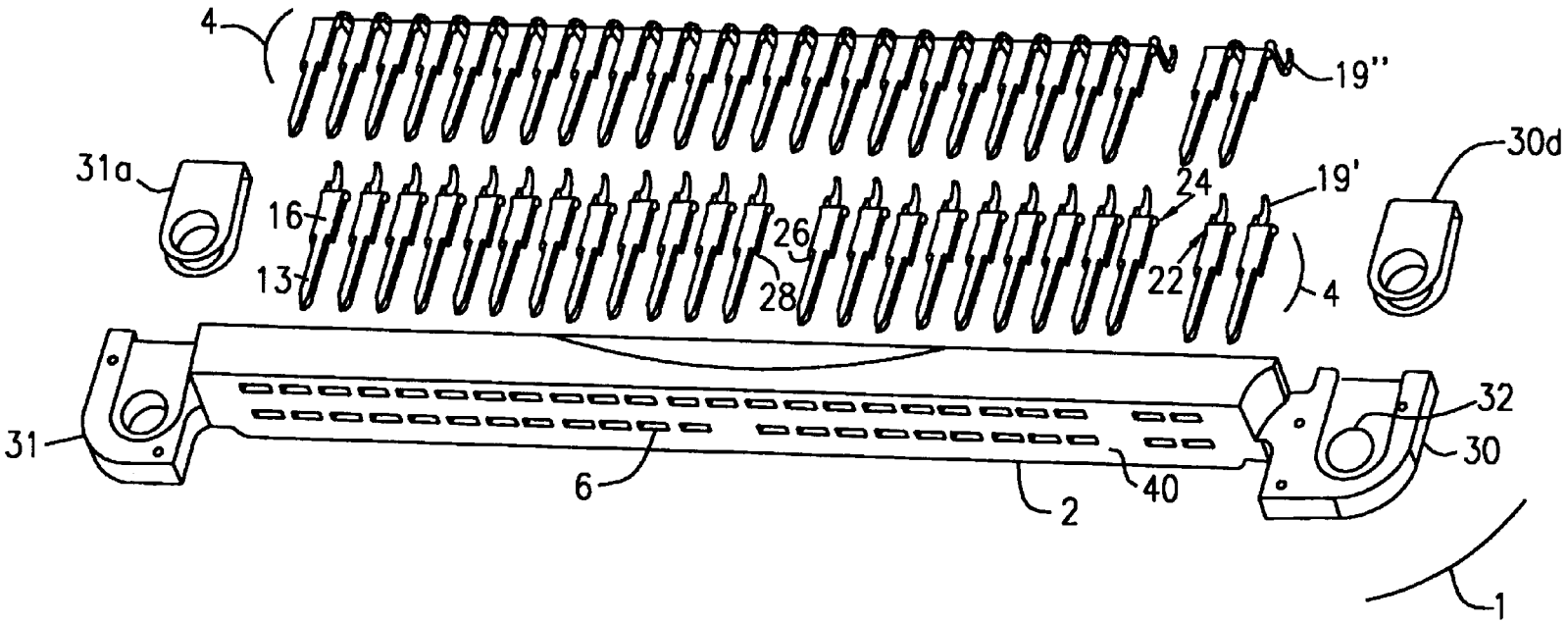
FIG. 1 is an exploded view of a connector for employing the contact retention method of the present invention.
Figure 2:
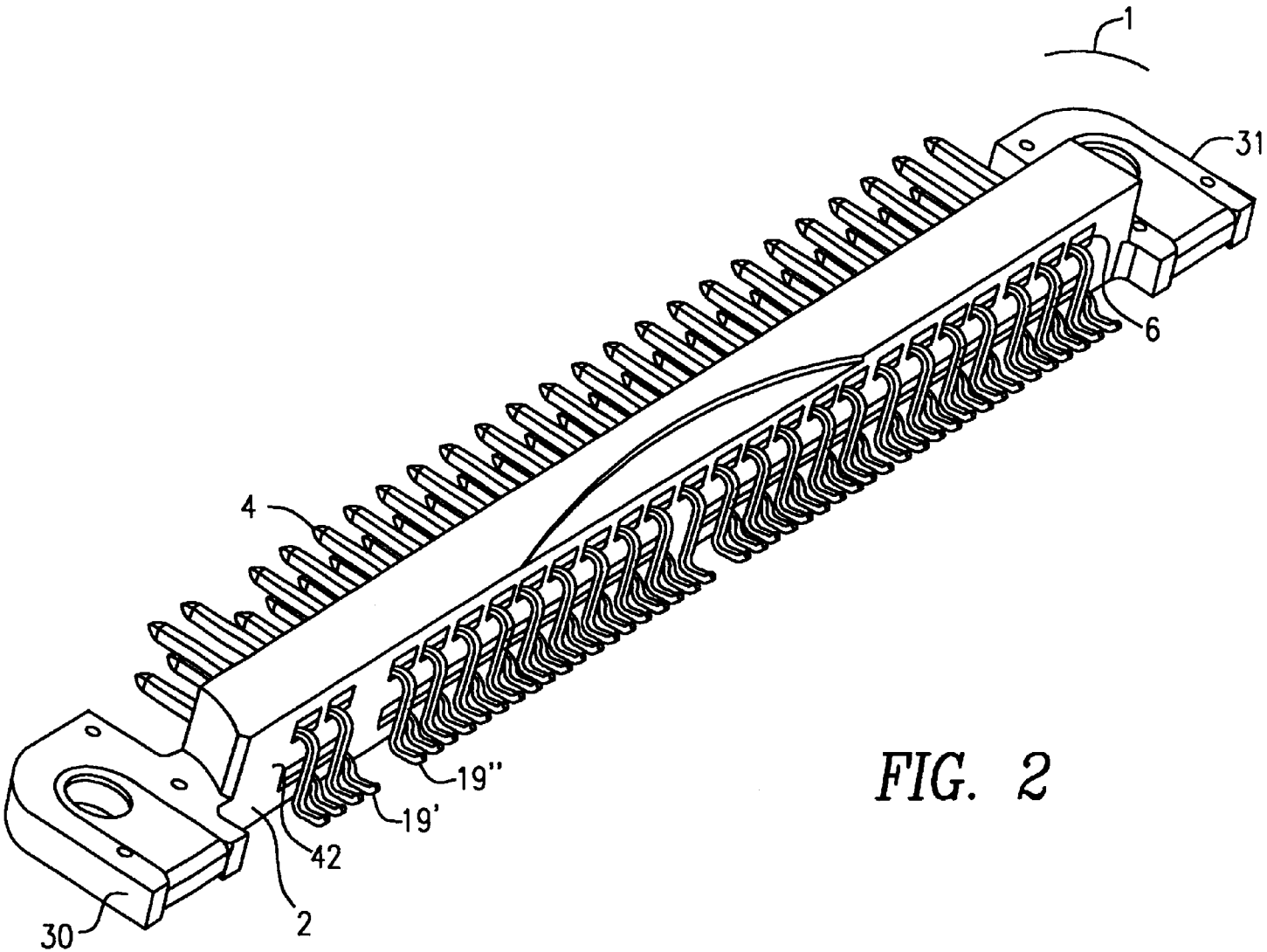
FIG. 2 is an isometric view of a connector employing the contact retention of the present invention.

As shown in FIGS. 1 and 2, the present invention provides an electrical connector 1 for establishing electrical connection between a mating electrical connector (not shown) and a printed circuit board (also not shown). In a preferred embodiment, electrical connector 1 includes a connector housing 2, which is a generally elongate rectangular member, fabricated from an electrically insulative material such as molded plastic. Housing 2 includes a plurality of apertures 6, which are generally rectangular in shape, through which the contacts 4 are inserted. The apertures 6 may be arranged in two longitudinally extending transversely spaced rows, as shown. However, other aperture shapes and arrangements of apertures are within the contemplation of the present invention.

The contacts 4 are elongate members typically stamped from a planar sheet of a conductive metal. The contacts 4 each include an elongate interconnection end in the shape of a pin 13, an opposed surface mount solder tail 19, and a central body 16 therebetween. While pins 13 and solder tails 19 are shown in the preferred embodiment, the configuration of contacts 4 is not limited thereto. Contact body 16 is an elongate flat planar member having extending shoulders 22, and 24 adjacent solder tails 19 and deformable retention flanges 26 and 28 adjacent pin 13.

Depending on the spacial relation and orientation between a particular contact 4 in the connector housing and the preferred location for connecting the corresponding solder tail 19, solder tail 19 may be a straight member or it may be bent into a configuration that provides connection of the solder tail 19 to a lead spaced away from the connector 1. FIGS. 1 and 2 show examples of a straight solder tail 19" which allow connection leads in a single plane as provided, for example, by a printed circuit board. While the figures show the contact with one end leading into a solder tail, this is not the only construction contemplated by the invention.

As shown in FIGS. 1 and 2 contacts 4 are positioned within housing 2 so as to permit electrical connection between contacts of a mating connector and traces on a printed circuit board. Pin 13 extends externally of a connection face 40 while solder tail 19 extends externally of an opposed termination face 42. As is well known in the connector art, pins 13 are designed for mating interconnection and solder tails 19 are designed for solder termination to a printed circuit board.

Figure 3A:
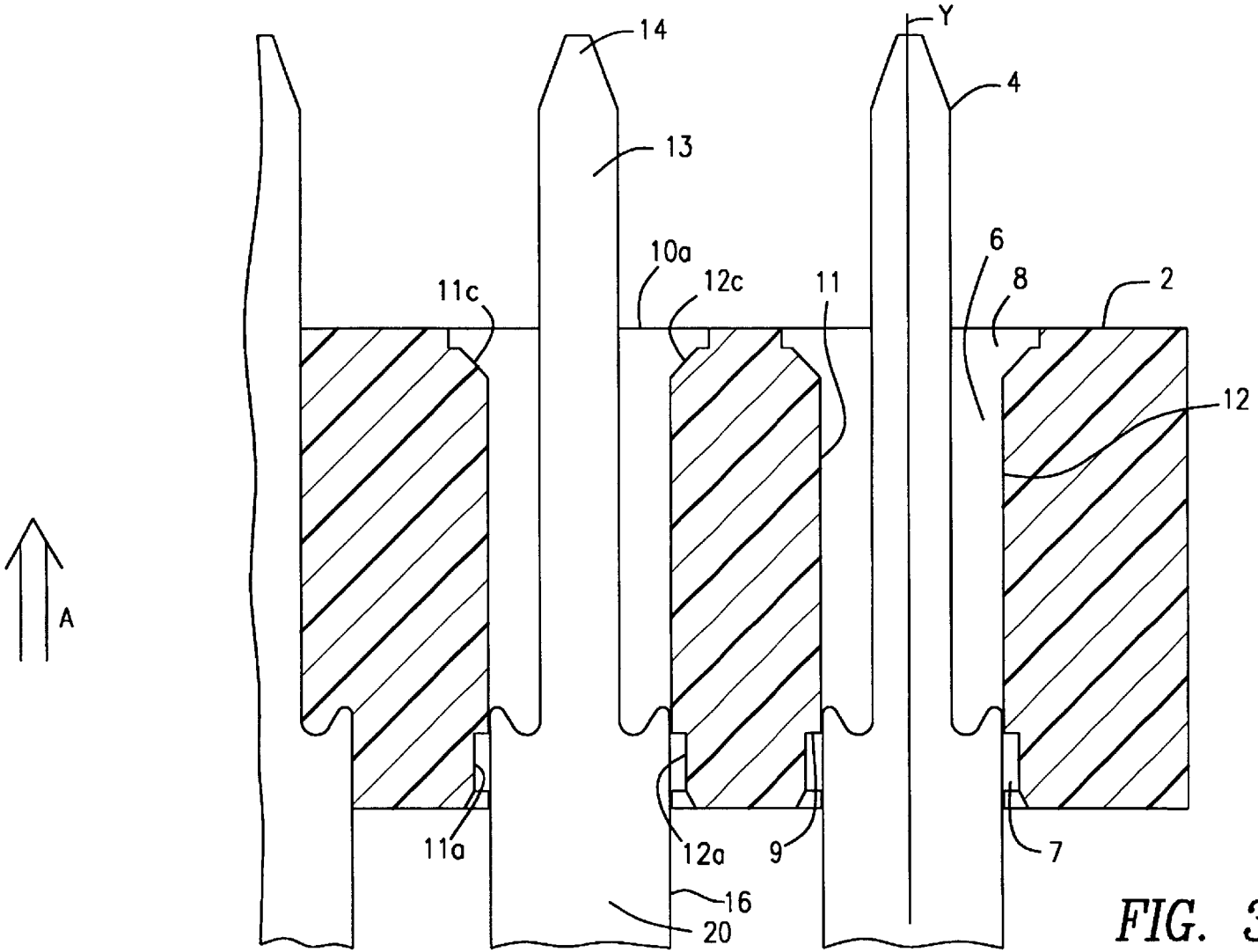
FIG. 3A is a cross-sectional view of the connector of FIG. 1 where the drawing shows the insertion of the contacts into the connector housing of the present invention.
Figure 3B:
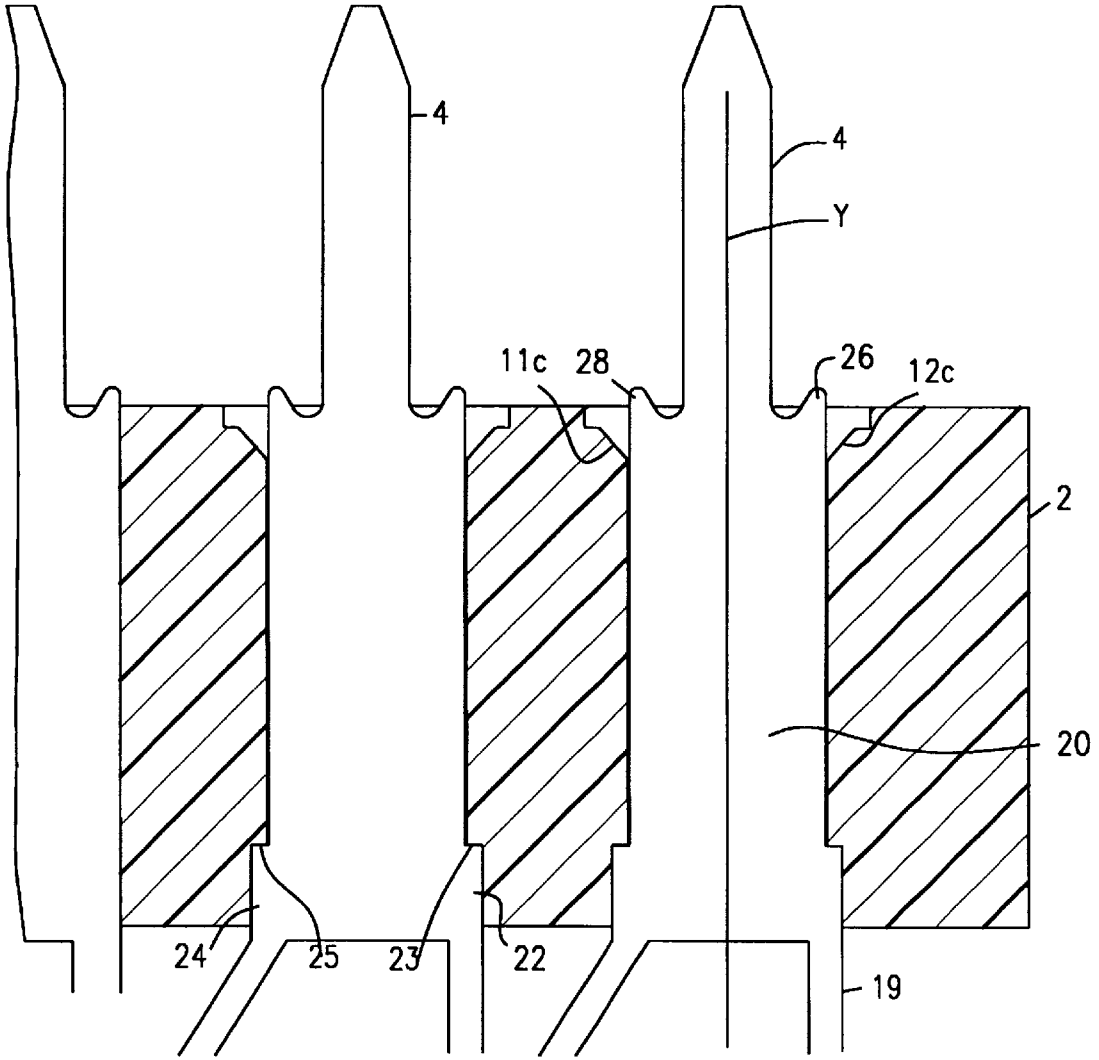
FIG. 3B is a cross-section view detailing a fully inserted contact in the connector housing of the present invention.
Figure 3C:
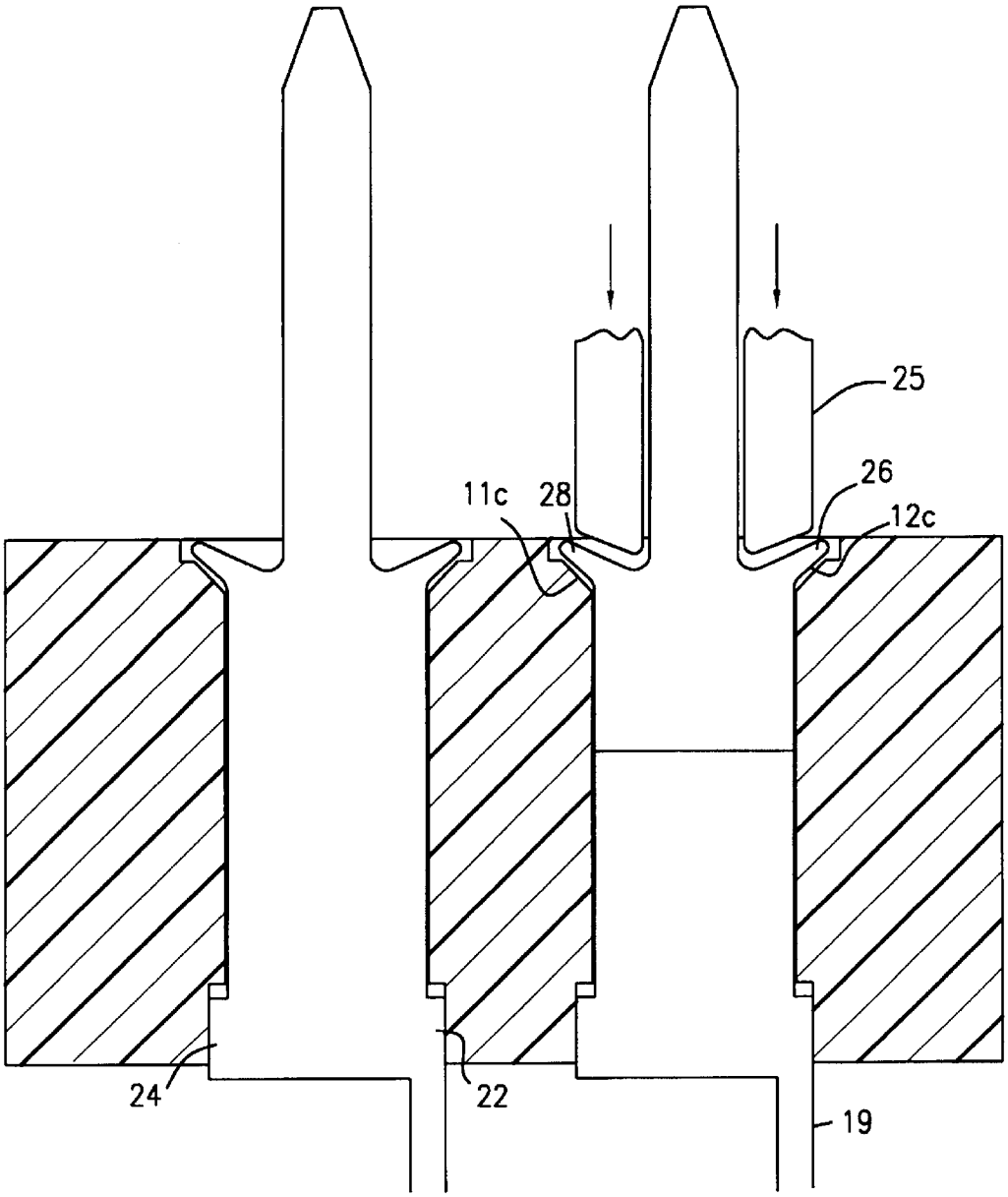
FIG. 3C is a cross-section view showing the swaging of the contacts inserted into the connector of the present invention.

FIGS. 3A–3C provide a cross-sectional view of a portion of connector housing 2. The apertures 6 are formed to cooperatively receive the contacts 4 inserted therethrough. Apertures 6 are elongate apertures defined between connection face 40 and termination face 42. Opposed side walls 11 and 12 of housing 2 further define aperture 6. The apertures 6 include recesses 7 and 8 at each longitudinal end thereof, namely connection face 40 and termination face 42 respectively.

Recess 7 is defined by a recessed surface 9, and is in communication with termination face 42. Recess 7 has a width which is greater than the width of a central portion 6*a* of aperture 6.

Recess 8 is defined by tapered walls 11*c* and 12*c* which open outwardly to connection face 40. Tapered walls 11*c* and 12*c* form a recess of increased width at connection face 40 which will engagingly receive deformable flanges 26 and 28 for retention.

While both the central contact body 16 and the receiving aperture 6 have been displayed in a rectangular shape, the invention is not limited to the rectangular shape, as other varieties of shapes are contemplated.

Contacts 4 are generally inserted into housing 2 from the termination face 42 towards the connection face 40 in the direction of arrow A. The contacts 4 are of such a dimension with respect to apertures 6 that free unrestricted insertion is permitted.

In the preferred embodiment shown herein, as the apertures 6 and contact body 16 of contacts 4 are both generally rectangular in cross-section, the shape and fit between contact body 16 and aperture 6 within connector housing 2 prevents the rotation of the contacts 4 about their longitudinal axis Y. The contacts 4 are inserted until the leading edges 23 and 25 of shoulders 22 and 24, which are wider than the contact body 16, cooperatively engage and seat against recessed surface 9. Such seating provides a mechanical stop and prevents over-insertion of the contacts 4 in housing 2. In this position, deformable retention flanges 26 and 28 are positioned so that the pin 13 extends fully through connector face 40 as shown in FIGS. 3B and 3C. FIG. 3B shows that once contact 4 is fully inserted into aperture 6, deformable retention flanges 26 and 28 are positioned adjacent to tapered walls 11*c* and 12*c*.

Referring to FIG. 3C, deformable retention flanges 26 and 28 may be swaged outwardly to abut tapered walls 11*c* and 12*c*. An appropriate tool 25 may be used to simultaneously swage both deformable retention flanges 26 and 28. The swaged retention flanges 26 and 28 thus reside against recess 8, to thereby lock contact 4 within the connector housing 2. The contact 4 is thus longitudinally confined by a retention force acting through contact 4 at flanges 26 and 28 adjacent connector face 40, and at shoulders 22 and 24 adjacent termination face 42.

Swaging the connector contacts 4 into place within the connector housing 2 provides a high retention force for maintaining contacts 4 within the connector housing throughout the lifetime of the connector. The high retention force provided by the present invention is obtained with a relatively low deformation force being applied to the deformable flanges 26 and 28. Thus the present invention allows the contacts 4 to be easily inserted into the connector housing 2 which eliminates misalignment of the pins 13 or solder tails 19 by the high insertion forces required by the prior art.

Because the present invention does not rely on an interference fit between the contacts 4 and the aperture 6 within connector housing 2 to maintain the contacts in place, the present invention also eliminates warpage caused by the interference fit of each contact with the connector housing.

Furthermore, in the present invention, the contact is not skewed in its entirety, which leads to unequal distribution on either side of the skewing and an off-balance resulting connection. The off-balance connection causes subsequent misalignment with printed circuit boards and results in a unusable electrical connector.

FIGS. 1 and 2 also illustrate connection ears 30 and 31 extending from housing 2 at each end thereof. Connection ears 30 and 31 provide for the securing of connector 1 to a circuit board so that the load is not borne by the solder tails 19. The ears 30 and 31 include mounting brackets 30*a* and 31*a* equipped for receipt of appropriate mounting hardware (not shown). The attachment of connector 1 to the printed circuit board may also be attained by other means well known in the art.

The present invention is intended to conform to the preceding description but is not limited thereto. In addition to those instances mentioned above which may deviate from the description, the shoulders of the contacts and the recessed surfaces against which they abut need not be limited to a rectangular shape.

What is claimed is:

1. An electrical connector comprising:

an insulative housing having a connection face and an opposed termination face, and further comprising a plurality of elongate apertures extending between the connection face and the termination face, said apertures having a width and a first end and an opposed second end and further defining first recesses at the connection face, said recesses having a width greater than the width of said apertures, and a plurality of elongate electrical contacts insertable within said housing apertures from said termination face to said connection face, said contacts having first ends extending externally through said first ends of said apertures and opposed second ends extending externally through said opposed second ends of said apertures, said contacts each further comprising a non-resiliently deformable flange adjacent said first ends of the contacts for expanded deformation into said recesses so as to prevent removal of said contacts from said housing apertures through said termination face.

2. An electrical connector according to claim 1 wherein said plurality of apertures are arranged in said housing in two longitudinally extending transversely spaced rows.

3. An electrical connector according to claim 1 wherein said apertures include seconds recesses adjacent said termination faces, and said recesses at said termination faces have widths which are greater than the widths of said apertures and which form transition surfaces thereabout.

4. An electrical connector according to claim 3 wherein said contacts include extending shoulders adjacent said second ends for engagement with said transition surfaces upon insertion of said contacts in said direction of insertion to thereby confine said contacts in said apertures and prevent over-insertion in said direction of insertion.

5. An electrical connector of claim 1 when each said flange are swagable to achieve said non-resilient deformation.

6. An electrical connector of claim 5 when each said contact includes a contact body and said flanges extending from said body.

7. An electrical connector of claim 6 when said flanges are swagable away from said contact body.

* * * * *